United States Patent [19]

Cruse et al.

[11] 4,304,541

[45] Dec. 8, 1981

[54] APPARATUS FOR MAKING TEXTURED BRICKS

[75] Inventors: William A. Cruse; John H. Isenhour, Jr., both of Salisbury, N.C.

[73] Assignee: Isenhour Brick & Tile Company, Inc., Salisbury, N.C.

[21] Appl. No.: 162,054

[22] Filed: Jun. 23, 1980

[51] Int. Cl.[3] ..... B28B 11/12; B28B 11/14

[52] U.S. Cl. ..... 425/296; 264/504; 425/301

[58] Field of Search ..... 425/301; 264/504, 296, 264/304

[56] References Cited

U.S. PATENT DOCUMENTS

| | | | |
|---|---|---|---|
| 1,207,272 | 5/1916 | Buckley | 425/301 |
| 1,783,287 | 12/1930 | Hilgendorf | 264/176 R |
| 3,784,533 | 1/1974 | Mach | 264/146 |
| 3,944,641 | 3/1976 | Lemelson | 264/145 |
| 4,160,638 | 7/1979 | Kolosson | 425/308 |

*Primary Examiner*—James H. Derrington

*Attorney, Agent, or Firm*—Mason, Fenwick & Lawrence

[57] ABSTRACT

Apparatus for making extruded bricks having a textured handmade appearing face designed to form the outer building wall surface, comprising a brick extruding die including a progressively narrowing inlet funnel portion having a downstream end and a constricted neck portion forming a material shaping die throat to receive a column of brick forming clay mix and shape the clay mix column to a rectangular cross-section whose width dimension perpendicular to said face slightly exceeds the desired brick width. A subsurface disrupting elongated thin bridge member transversely spans the die throat and is supplied with liquid under pressure to produce downstream directed liquid jets internally disrupting the clay mix column in the die throat immediately below the upper boundry surface thereof along a substantially horizontal disruption plane. Devices are provided with structure downstream of the die throat for plowing off the uppermost strata of the clay mix column to the level of said disruption plane to expose the disrupted zone and form the textured handmade appearing face and for slicing the exiting column into discete bricks.

16 Claims, 8 Drawing Figures

APPARATUS FOR MAKING TEXTURED BRICKS

BACKGROUND AND OBJECTS OF THE INVENTION

The present invention relates in general to processes and apparatus for forming facing bricks used in building construction to provide a rough textured face simulating handmade brick, and more particularly to processes and apparatus for forming textured, rough-looking extruded brick from a column of clay advanced through a brick extrusion die wherein the face of the brick produced has an attractive artistic surface having the appearance of being old, worn and weather-beaten with discontinuities or disruptions in the surface of the brick face.

It has been known for a long time that bricks can be given a rough texture or old, weather-beaten appearance simulating the weathered and roughened appearance of old handmade brick by various surface agitating or disrupting processes. One technique which has long been proposed in the art of brick-making was to veneer the exposed surfaces with a different type of clay than was used for the major body of the brick, enabling an inferior grade brick material to be used for the body of the brick with the exposure portions having the appearance of high-grade bricks. Various methods were proposed to roughen the exposed surfaces so that the brick would have a weathered appearance, such bring being frequently referred to as "textured" bricks. Various methods have been proposed for subjecting a clay column issuing from a brick-forming extrusion die to pressurized sprays of water, steam or wet mixes of granular material to provide the weathered or textured appearance.

For example, the Poston U.S. Pat. No. 1,641,047 discloses apparatus for texturing brick wherein the wet clay column issuing from a die and moving along a conveyor belt is textured, prior to cutting it into bricks, by blowing granulated clay or other granulated particles against the surfaces by high-pressure steam or compressed air discharged through variously positioned nozzles, whereby the particles strike the plastic column forming the brick and cut into the smooth surface of the column "sufficiently to break up the smoothness thereof and produce a surface that is natural in appearance".

The Tefft U.S. Pat. No. 1,896,126 also discloses apparatus and process for texturing the surface of bricks to produce a roughened weathered appearance, by forcing the clay through an extrusion die and subjecting the clay column as it passes from the die plate to the discharge die to a textured slush or mixture formed, for example, of sand, clay, coloring matter and enough water to give it a desired consistency, so that the mixture surrounds the column and causes the exposed faces of the column to become roughened and cause some of the material to be ground into the surface of the column.

The prior Hilgendorf U.S. Pat. No. 1,783,287 proposes a system wherein the clay column passing through an extrusion die is subjected to pressurized steam admitted through a supply pipe surrounding the clay column for the purpose of lubricating or moistening the surface of the clay as it is is being split into two columns during passage through the die.

Straight U.S. Pat. No. 1,859,723 discloses a system wherein the bricks, after they have been dried, are subjected to a jet of sand from a discharge nozzle to sandblast the brick and provide an appearance of being old, worn and weather-beaten.

Also the Tuttle U.S. Pat. No. 1,977,868 discloses a process for making bricks which imitate old bricks by directing showers or sprays of water at various angles against the brick moving along a conveyor belt on which they are deposited from a brick mold.

While the above described prior art processes have produced brick with roughened textures, such have not produced antiguing, weathering or texturing effects to the desired extent and with the desired consistency, and frequently have been detrimental to the properties of the brick. Natural laminations to achieve rough textures have been used in the brick industry, but such natural laminations are detrimental to the strength and durability of the brick produced because the laminations are distributed throughout the brick body and represent weaknesses throughout the body. The texturing affects to be produced by laminations or discontinuities in the clay material should be located in such way as to not adversely effect the strength of the body of the brick. Also, it is desirable to be able to control the extent of roughness imparted to the texture or character of the face of the brick, and to have an extrusion process which textures the successive bricks differently so that the bricks are not exactly alike and thus more nearly simulate the variations in appearance resulting from old handmade brick.

An object of the present invention, therefore, is the provision of a novel process and apparatus for producing a controllable rough-looking texture on extruded brick, by creating a pressurized fluid induced discontinuity or lamination inside the clay column in a brick extrusion die just below the surface of the column, and wherein this discontinuity or lamination zone of the column is exposed to form the face of the brick providing the desired rough texture which varies somewhat from brick to brick and provides a novel texturing character.

Another object of the present invention is the provision of a brick extrusion process and apparatus as described in the preceding paragraph, wherein a texturing blade in the form of a bridge spans the clay column moving through the brick extrusion die just below the surface of the column, and is provided with water or similar fluid under pressure exiting through a slot into the flowing stream of clay to create the discontinuities or laminations inside the clay column without detrimental affect to the strength and durability of the body of the brick.

Another object of the present invention is the provision of a novel process and apparatus for forming rough textured extruded brick as described in either of the two immediately preceding paragraphs, wherein the flow rate of injected fluid may be controlled to vary the texturing from non-rough to very-rough over the span of a few bricks to produce successive bricks with different amounts of roughness or texturing.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
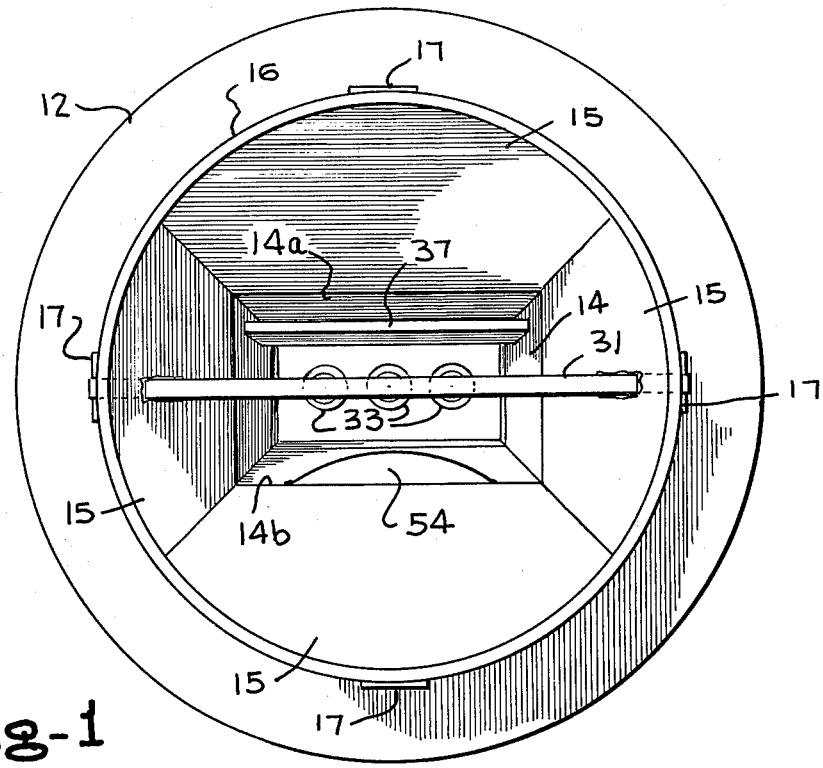
FIG. 1 is a front elevational view of a brick extrusion die for producing rough textured brick in accordance with the present invention.
Figure 8:
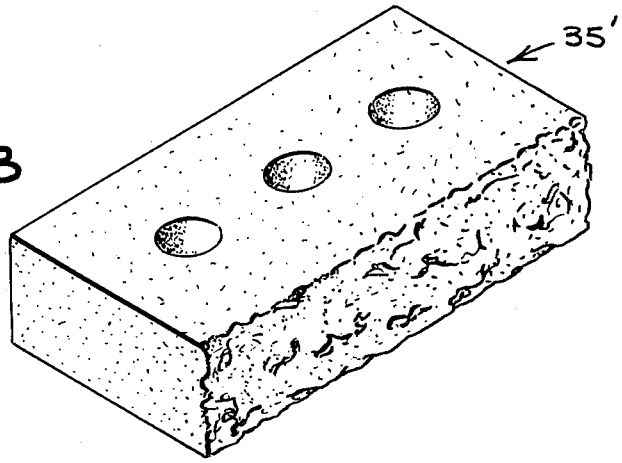
FIG. 8 is a perspective view of bricks produced by the process of the present invention.

Referring to the drawings, wherein like reference characters designate corresponding parts throughout the several figures, the variable rough textured building construction brick, simulating handmade brick, to be produced by the apparatus and process of the present invention is formed by a brick extrusion processing line wherein a mixture of clay to form bricks of desired physical qualities and color is fed as a continuous column of clay to a novel brick extrusion die, indicated generally by the reference character 10. The die 10 discharges an extruded die-formed column of clay of appropriate cross-section and character to a conveyor, indicated diagrammatically at 11 where the extruded discharge column of clay is processed as later described and cut by conventional separate brick cutting devices and processed in the usual manner to form construction brick.

The novel brick extrusion die 10 of the present invention includes a generally circular base plate 12 which is supported in the conventional manner in a vertical plane transverse to the path of movement of the entering column of clay. The die base plate 12 has a generally centrally located shaped opening 14 through which the column of clay passes, the boundary surfaces 14*a* of which incline along downstream convergent planes. In the illustrated embodiment, four entrance throat plates 15 converge in a downstream direction along upper and lower inclined planes having horizontal axes and side inclined planes having vertical axes to join the horizontal and vertical edges of the rectangular entrance end of opening 14, providing a progressively converging entrance throat into which the clay column is fed and progressively constricted or squeezed as it passes through the rectangular opening 14 in the extrusion die base plate 12. To provide structural rigidity, the downstream edges 15*a* of the entrance throat plates 15 are welded to the upstream face of the die base plate 12, and the upstream of feed edges of the throat plates 15 are welded to the inner surface of a tubular cylindrical shroud 16 which projects in an upstream direction from the die base plate 12. The tubular cylindrical shroud 16 may be assembled to the circular base plate 12, for example, by four channel-shaped boxes 17 welded at adjoining portions to the shroud 16 and fastened by bolts 18 extending through a wall of the associated anchoring box 17 and into a tapped opening therefor in the die base plate 12.

Extending in a downstream direction from the base plate 12 is a second progressively constricting die throat section 20 formed of downstream converging inclined top and bottom plates 21*a*,21*b*, and side plates 22, welded at their upstream ends to the die base plate 12 and having, in the illustrated embodiment, pairs of subsurface liner plates 23 and liner plates 24 arranged in laminar fashion over the inwardly facing surfaces of the second throat section throat plates 21*a*,21*b*. The upper and lower inclined throat plates 21*a*,21*b* each have a pair of upwardly and downwardly projecting mounting ears 25 welded thereto at their downstream edges apertured to receive threaded bolts 26 extending through a rectangular clamping plate 27 which is centrally apertured as indicated at 27*a* to admit a rectangular exit die section 29, for example having walls about $\frac{7}{8}$th of an inch thick, whose upstream end butts against the downstream end of the second constricting die throat section 20 and is held thereagainst by the clamping plate 27 abutting against clamping shoulders 30 which at locations outwardly surround the walls of the exit die section 29 and are welded thereto.

A core pin support bar 31 transversely spans the first entrance throat section 32 defined by the entrance throat plate 15, at a location near the upstream end of the entrance throat section 32, which is welded at its opposite ends to the entrance throat side plates 15*a* as shown, and which has welded thereto three rearwardly or downstream extending pins or rods 33 of about 1-$\frac{1}{8}$" diameter having constricted threaded downstream end portions 33*a* on which core members 34 (for example about 1-7/16" diameter core sleeves) are fitted and retained by mounting nuts 33*b*. These extend along the horizontal medial plane of the clay column discharged or exiting from the brick extrusion die (here indicated by the reference character 35) to form the usual three core holes or cavities in the final brick.

Figure 4:
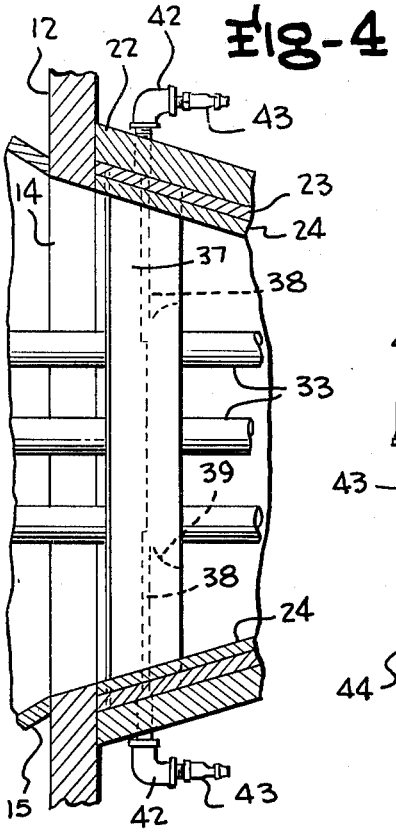
FIG. 4 is a fragmentary transverse section view taken along the line 4—4 of FIG. 2.
Figure 5:
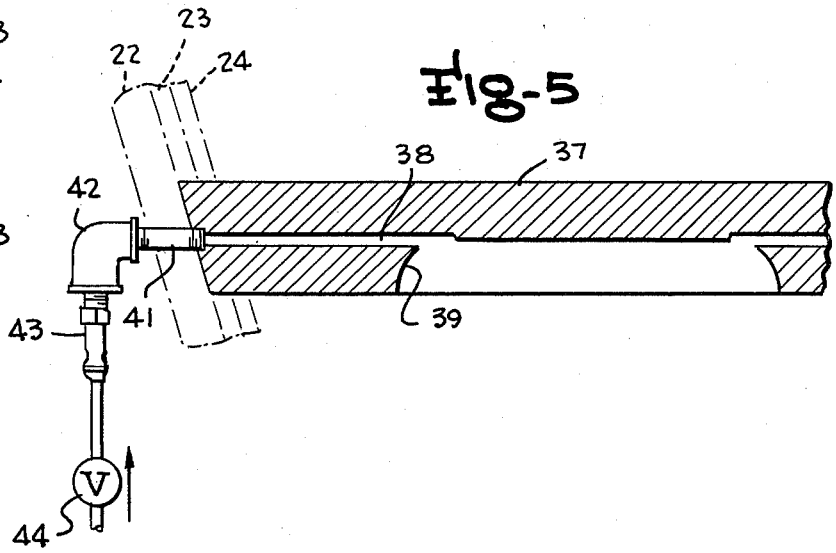
FIG. 5 is a fragmentary section view through the texturing blade along the medial plane thereof as indicated by the line 5—5 of FIG. 6.
Figure 6:
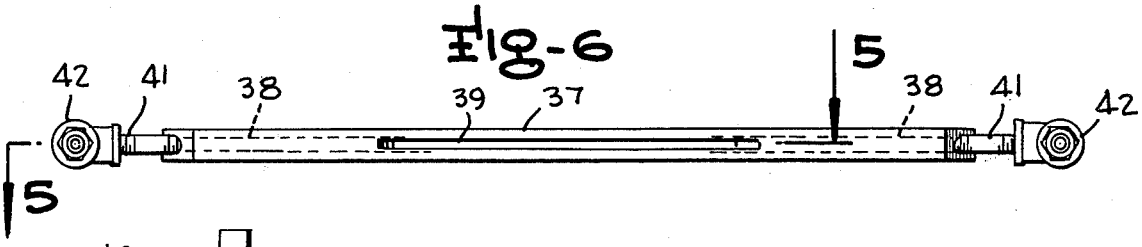
FIG. 6 is a rear elevational view of the removable texturing blade, shown as a separate structure.
Figure 7:
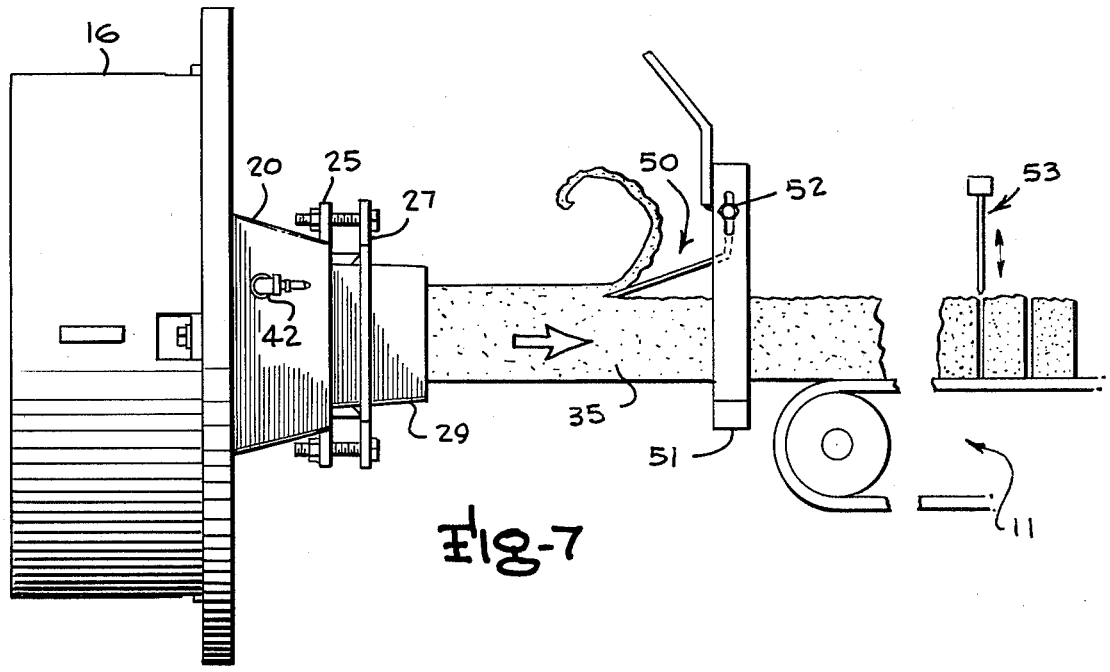
FIG. 7 is a somewhat diagrammatic side elevational view showing the extrusion die together with the brick column surface plowing blade and adjacent portions of the conveyor structure as used in the process of the present invention.

To provide the novel controllable texturing or rough-looking effects of the present invention, the brick extrusion die is also provided with a removable texturing blade member 37 which spans the interior die cavity space or chamber of the second constricting die throat section 20 near the upstream end thereof, along a horizontal axis, and which is a generally slat-like blade having a vertical thickness of about $\frac{1}{2}$" and a length of about 2", with an internal fluid passage or bore 38 extending substantially along the center axis of the blade throughout its entire length and communicating with a discharge slot portion 39 opening through the downstream edge of the blade 37, having a typical configuration as illustrated in FIG. 5. The blade may be of isosceles trapezoidal or truncated triangular configuration as illustrated in FIG. 4, with its lateral ends converging in a downstream direction as shown, and is preferably inclined at an angle of, for example, about 11° to the horizontal in an upstream direction. In one staisfactory example, the major plane (the top or bottom surface plane) of the texturing blade may incline upwardly from the horizontal in an upstream direction by about 11°, while the plane of the nearest adjacent inclined upper surface 14*a* of the die plate opening 14 or the surface of the nearest adjacent liner plate 24 may be inclined about 14.25° from the horizontal in an upstream diverging direction.

The opposite ends of the blade 37 where the passage 38 exits from the blade are bored to provide a slightly larger diameter bore section threaded to receive threaded short pipe sections 41 (for example 1-$\frac{1}{2}$"$\times\frac{1}{8}$"

standard pipe nipples) to which is coupled a threaded elbow member 42 and a standard ½" air/water coupling 43 for connecting the passage 38 and slot 39 to a suitable pressurized fluid source, usually water, which may regulated by a conventional hand-valve as indicated diagrammatically at 44.

With this brick extrusion die construction, the supply or entering column of clay from the usual clay column producing apparatus well known in the brick industry is supplied under pressure appropriate to brick extrusion dies to the upstream convergent throat section 32 between the entrance throat plates 15 where the clay is progressively squeezed into narrower cross-sectional dimensions by the inclined entrance throat plates 15 and passes around the core pin support bar 31 transversely planning the entrance throat section 32 and flows toward the exit end around the core pins 33. As the clay column reaches the texturing blade 37, it divides around the texturing blade, which is approximately ½"×2" in cross-section, and as the clay column reaches a position immediately downstream from the downstream end of the texturing blade 37, fluid under pressure (usually water) fed to the passage 38 in the texturing blade 37 exits under the supply pressure in a downstream direction through the horizontally elongated exit slot 39 at a location approximately ¼" below the top surface of the clay column 35 which exits from the downstream end of the exit die section 29. This pressurized discharge of water or other fluid exiting through the discharge slot 39 in the texturing blade 37 into the flowing stream of clay creates a discontinuity or "lamination" inside the clay column just below the upper surface of the column. In a satisfactory preferred example, the medial horizontal plane through the exit end of this fluid discharge slot 39 in the texturing blade 37 is located ¼" below the edge of the bottom surface of the top wall of the exit die section 29 (that is ¼" below the top of the opening at the downstream or exit end of this exit section 29). The exit column of clay 35 leaving the exit die section 29 of the extrusion die 10 then passes through a layer cut-off or plow station immediately downstream from the discharge end of the die, provided with a cutting blade, indicated generally by the reference character 50, which is adjustably positioned on a supporting frame 51 supported, for example, from the extrusion die 10 or the machine support for the extrusion die 10, to plow off the top ¼" excess of the exit clay column 35 and thus reveal the discontinuities or laminations that resulted from the pressurized fluid injection discharge from the texturing blade 37. This surface plowing blade 50 is adjustable to the desired approximately ¼" depth of cut by, for example, providing a bolt and vertically elongated slot-type mounting, as indicated at 52, on the supporting frame 51 to establish the desired depth of cut. Discrete bricks 35' are formed by slicing the column with conventional cutting means indicated at 53.

Figure 3:
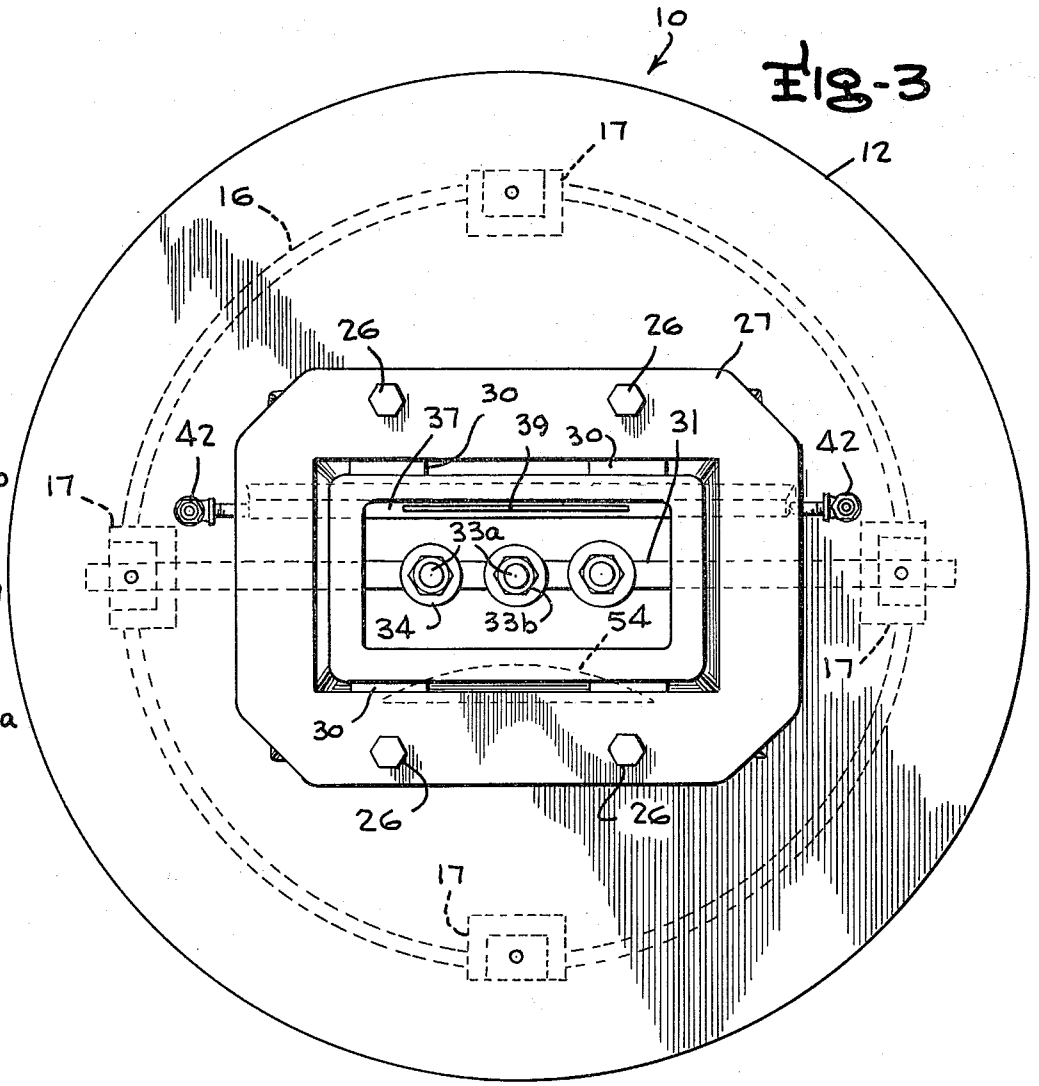
FIG. 3 is a rear elevation view of the brick extrusion die viewed from the discharge end thereof.
Figure 2:
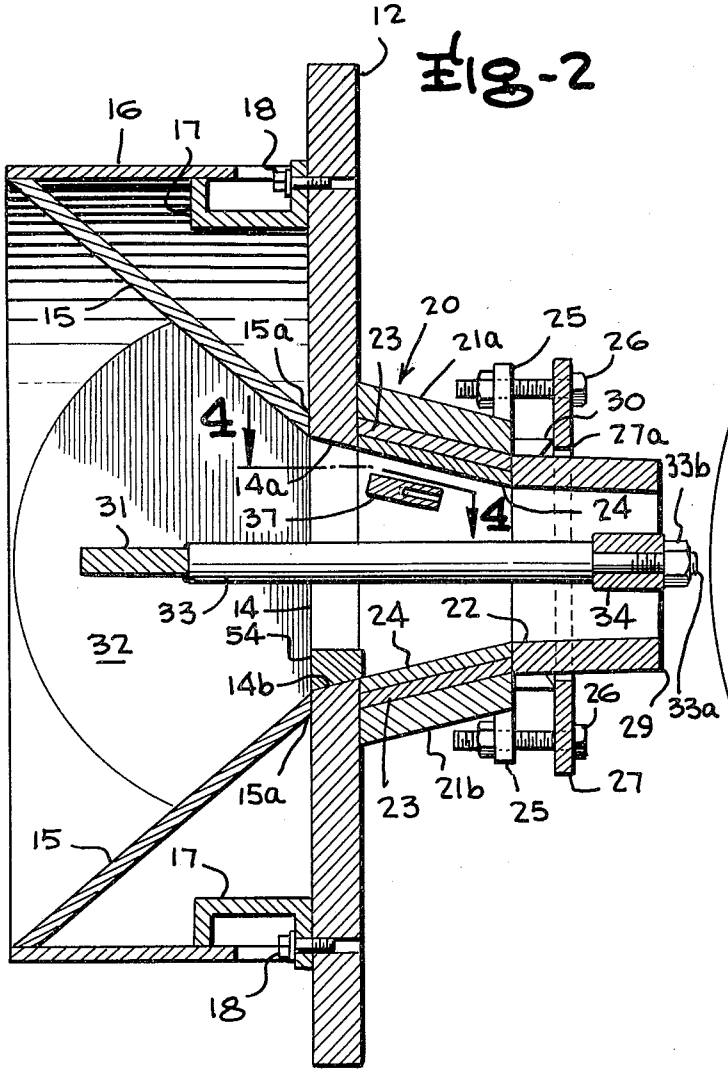
FIG. 2 is a vertical longitudinal section view of the brick extrusion die, taken along the line 2—2 of FIG. 1.

In order to balance the drag of the texturing blade 37 in the path of the clay column moving through the extrusion die 10, a convex segment-shaped retarder 54 is fixed to the inclined lower boundary surface **14*b* of the opening 14 in the extrusion die base plate 12 which has the approximate configurations shown in FIG. 3**. This is provided so that the clay will not flow faster in one part of the die than the other.

Very good results in providing bricks having the surface appearance of antique handmade brick have been achieved, using plain water as the fluid discharged through the discharge slot 39 of the texturing blade 37, for example injected at approximately 15 gals. per/hr. at a pressure of about 180–200 p.s.i.

With the process and apparatus of the present invention, it has been found that the laminations or discontinuities produced by the discharged liquid fluid stream from the texturing blade at a location immediately below the top surface of the brick column passing through the extrusion die, exposed by the plowing-off of a thin top layer of the brick column exiting from the die to approximately the level of the pressurized-fluid-produced discontinuities, results in a striking rough "handmade" like texture on the surface of the brick without adversely effecting the strength of the body of the brick. Also, this particular process of induced lamination or discontinuity in combination with the inherent variations of the clay extrusion process produces textures in which no two bricks are exactly alike, thus closely simulating the old handmade brick by use of a machine process. Furthermore, by controlling the flow rate of the injected fluid supplied to the texturing blade 37 and discharge from its slots 39, the texture can be varied readily from non-rough to very-rough over the span of a few bricks. This provides great variety enhancing the antique-like appearance effects on the surface of the brick. Also the structure lends itself readily to cutting the fluid supplied to the texturing blade 37 on and off in a cyclical manner by motorized valve control devices of well known construction, which produces a controllable mixture of rough and non-rough brick to produce a desirable mix of different types of brick texturing surfaces.

While but one preferred embodiment of the extrusion die structure usable in carrying out the process of the present invention has been specifically shown and described, it will be apparent that other variations thereof may be made to accomplish the same effects by different specific die structure arrangements, within the spirit and scope of the present invention.

I claim:

1. Apparatus for making extruded bricks having a textured handmade appearing face designed to form the outer building wall surface, comprising a brick extruding die including a progressively narrowing inlet funnel portion having a downstream end and a constricted neck portion forming a material shaping die throat communicating with the downstream end of the inlet portion to receive a column of brick forming clay mix therefrom, the die throat having confronting pairs of horizontally and vertically extending spaced planiform boundary surfaces to shape the clay mix column to a rectangular cross-section whose width dimension perpendicular to said face slightly exceeds the desired brick width, a subsurface disrupting elongated thin bridge member spaced near and below the uppermost horizontally extending boundry surface transversely spanning the die throat having an internal longitudinal fluid passage therethrough communicating with downstream directed fluid discharge opening portions in the bridge member, means for supplying liquid under pressure to said fluid passage producing downstream directed liquid jets internally disrupting the clay mix column in said die throat immediately below the upper boundary surface thereof along a substantially horizontal disruption plane, means downstream of said die throat for plowing off the uppermost strata of the clay mix column exiting from said die throat to the level of said disruption plane to expose the disrupted zone to form said textured handmade appearing face, and means for slicing the exiting column along planes perpendicular to the direction of movement thereof into discete bricks.

2. Apparatus for making extruded bricks as defined in claim 1, wherein said bridge member is a generally slat-like blade which longitudinally spans the full transverse width of the die throat and is of substantially greater width in a direction parallel to the direction of movement of the clay column through the throat than its vertical thickness.

3. Apparatus for making extruded bricks as defined in claim 1, wherein said bridge member is a generally slat-like blade which longitudinally spans the full transverse width of the die throat and is of substantially greater width in a direction parallel to the direction of movement of the clay column through the throat than its vertical thickness providing substantially parallel upper and lower flat blade faces disposed parallel to said uppermost boundry surface of the die throat.

4. Apparatus for making extruded bricks as defined in claim 1, wherein said horizontally extending planiform boundry surfaces of the die throat are arranged in downstream converging inclined planes extending parallel to a horizontal axis and the vertically extending boundry surfaces also extend along downstream converging inclined planes paralleling a vertical axis, whereby said boundry surfaces provide a progressively constricting throat for shaping the clay mix column to the desired cross-sectional shape and size.

5. Apparatus for making extruded bricks as defined in claim 2, wherein said horizontally extending planiform boundary surfaces of the die throat are arranged in downstream converging inclined planes extending parallel to a horizontal axis and the vertically extending boundary surfaces also extend along downstream converging inclined planes paralleling a vertical axis, whereby said boundry surfaces provide a progressively constricting throat for shaping the clay mix column to the desired cross-sectional shape and size.

6. Apparatus for making extruded bricks as defined in claim 3, wherein said horizontally extending planiform boundary surfaces of the die throat are arranged in downstream converging inclined planes extending parallel to a horizontal axis and the vertically extending boundry surfaces also extend along downstream converging inclined planes paralleling a vertical axis, whereby said boundry surfaces provide a progressively constricting throat for shaping the clay mix column to the desired cross-sectional shape and size.

7. Apparatus for making extruded bricks as defined in claim 2, wherein said inlet funnel portion and said die throat are substantially concentric with and arranged serially along a feed axis for the clay mix column therethrough and the blade-shaped bridge member is arranged with its center plane inclined in a downstream convergent direction to said feed axis with the longitudinal center axis of the blade parallel to the horizontal.

8. Apparatus for making extruded bricks as defined in claim 3, wherein said inlet funnel portion and said die throat are substantially concentric with and arranged serially along a feed axis for the clay mix column therethrough and the blade-shaped bridge member is arranged with its center plane inclined in a downstream convergent direction to said feed axis with the longitudinal center axis of the blade parallel to the horizontal.

9. Apparatus for making extruded bricks as defined in claim 5, wherein said inlet funnel portion and said die throat are substantially concentric with and arranged serially along a feed axis for the clay mix column therethrough and the blade-shaped bridge member is arranged with its center plane inclined in a downstream convergent direction to said feed axis with the longitudinal center axis of the blade parallel to the horizontal.

10. Apparatus for making extruded bricks as defined in claim 1, wherein said discharge opening portions in the bridge member form a continuous slot in the downstream edge of the bridge member which is elongated transversely of the die throat to span a substantial portion of the length of the bridge member transversely of the die throat and said longitudinal fluid passage extends from the opposite ends of said slot substantially along the longitudinal center line of the bridge member to respective adjacent ends of the bridge member for connection to a source of liquid under pressure.

11. Apparatus for making extruded bricks as defined in claim 2, wherein said discharge opening portions in the bridge member form a continuous slot in the downstream edge of the bridge member which is elongated transversely of the die throat to span a substantial portion of the length of the bridge member transversely of the die throat and said longitudinal fluid passage extends from the opposite ends of said slot substantially along the longitudinal center line of the bridge member to respective adjacent ends of the bridge member for connection to a source of liquid under pressure.

12. Apparatus for making extruded bricks as defined in claim 3, wherein said discharge opening portions in the bridge member form a continuous slot in the downstream edge of the bridge member which is elongated transversely of the die throat to span a substantial portion of the length of the bridge member transversely of the die throat and said longitudinal fluid passage extends from the opposite ends of said slot substantially along the longitudinal center line of the bridge member to respective adjacent ends of the bridge member for connection to a source of liquid under pressure.

13. Apparatus as defined in claim 1, including a convex segment-shaped retarder member fixed to the lowermost boundary surface of the die throat at the entrance thereto to balance the drag of the bridge member in the path of the clay column so that the clay will not flow faster in the lower part of the die throat than the upper part.

14. Apparatus as defined in claim 2, including a convex segment-shaped retarder member fixed to the lowermost boundary surface of the die throat at the entrance thereto to balance the drag of the bridge member in the path of the clay column so that the clay will not flow faster in the lower part of the die throat than the upper part.

15. Apparatus as defined in claim 3, including a convex segment-shaped retarder member fixed to the lowermost boundary surface of the die throat at the entrance thereto to balance the drag of the bridge member in the path of the clay column so that the clay will not flow faster in the lower part of the die throat than the upper part.

16. Apparatus as defined in claim 11, including a convex segment-shaped retarder member fixed to the lowermost boundary surface of the die throat at the entrance thereto to balance the drag of the bridge member in the path of the clay column so that the clay will not flow faster in the lower part of the die throat than the upper part.

* * * * *